US008508093B2

(12) United States Patent
Wu et al.

(10) Patent No.: US 8,508,093 B2
(45) Date of Patent: Aug. 13, 2013

(54) HEAT DISSIPATION FAN WITH MAGNET RING OF VARYING THICKNESS

(75) Inventors: Hong-Tao Wu, Shenzhen (CN); Yong-Kang Zhang, Shenzhen (CN); Yung-Ping Lin, New Taipei (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 179 days.

(21) Appl. No.: 13/236,615

(22) Filed: Sep. 19, 2011

(65) Prior Publication Data

US 2012/0313475 A1 Dec. 13, 2012

(30) Foreign Application Priority Data

Jun. 8, 2011 (CN) ..... 2011 1 0152297

(51) Int. Cl.
*H02K 21/12* (2006.01)

(52) U.S. Cl.
USPC ..... 310/156.38; 310/156.45

(58) Field of Classification Search
USPC ..... 310/156.38–156.45, 64, 61–62, 267
See application file for complete search history.

(56) References Cited

U.S. PATENT DOCUMENTS

| | | | | |
|---|---|---|---|---|
| 4,482,849 | A * | 11/1984 | Doemen et al. | 318/400.41 |
| 6,657,328 | B2 * | 12/2003 | Shiga et al. | 310/26 |
| 7,495,362 | B2 * | 2/2009 | Tung et al. | 310/156.26 |
| 7,508,106 | B2 * | 3/2009 | Hashiba | 310/156.38 |
| 8,067,870 | B2 * | 11/2011 | Kobayashi et al. | 310/156.05 |
| 8,344,568 | B2 * | 1/2013 | Bailey et al. | 310/156.12 |
| 2005/0099080 | A1 * | 5/2005 | Matsumoto et al. | 310/156.26 |
| 2007/0013242 | A1 * | 1/2007 | Tung et al. | 310/67 R |
| 2007/0080604 | A1 * | 4/2007 | Yang et al. | 310/257 |
| 2008/0174212 | A1 * | 7/2008 | Rudel et al. | 310/68 B |

* cited by examiner

*Primary Examiner* — Thanh Lam
(74) *Attorney, Agent, or Firm* — Altis Law Group, Inc.

(57) ABSTRACT

An exemplary heat dissipation fan includes a rotor and a stator. The stator includes a stator core. The rotor is rotatably mounted around the stator. The rotor includes a hub and a magnet ring received in the hub. The hub includes a top wall and a peripheral side wall depending from the top wall. The magnet ring is attached to the side wall and surrounding the stator. The magnet ring has a larger thickness as measured in a radial direction at a first end which is far away from the top wall than a second end which is adjacent to top wall, such that an attracting force formed between the first end of the magnet ring and the stator core is larger than that formed between the second end of the magnet ring and the stator core.

20 Claims, 5 Drawing Sheets

HEAT DISSIPATION FAN WITH MAGNET RING OF VARYING THICKNESS

BACKGROUND

1. Technical Field

The disclosure relates to electronic device cooling, and particularly to a heat dissipation fan providing stable rotation of a rotor thereof.

2. Description of the Related Art

With the continuing development of electronics technology, electronic packages such as CPUs (central processing units) employed in electronic devices are generating more and more heat. The heat requires immediate dissipation in order that the CPU and the electronic device can continue to operate stably. A heat dissipation fan is commonly used in combination with a heat sink for cooling the CPU.

A conventional heat dissipation fan includes a stator, and a rotor having a hub with a plurality of blades extending from the hub. The stator establishes an alternating magnetic field interacting with a magnetic field of the rotor to drive the rotor to rotate. Thus the rotation of the blades generates a forced airflow, for cooling the heat sink and the CPU. The stator includes a bearing defining a bearing hole therein. The rotor has a shaft extending into the bearing hole and is thus rotatably supported by the bearing.

However, during rotation of the rotor, the rotating blades generate an external pressure which pulls the rotor to move upwardly along an axial direction away from a base of the stator. When this happens, the rotor is said to be in a "floating" condition. The floating rotor is inclined to generate noise, which may be annoying or even unacceptable.

What is desired, therefore, is a heat dissipation fan which can overcome the above-described shortcomings.

DETAILED DESCRIPTION

Reference will now be made to the figures to describe an embodiment of the present heat dissipation fan in detail.

Figure 1:
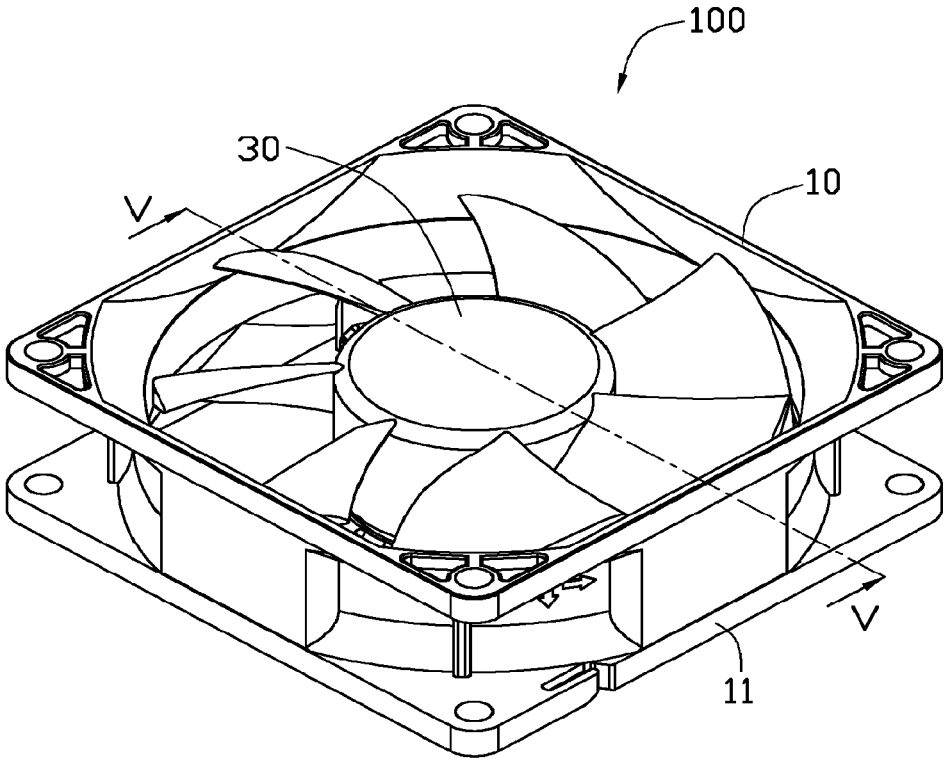
FIG. 1 is an isometric, assembled view of a heat dissipation fan according to an exemplary embodiment of the present disclosure.
Figure 2:
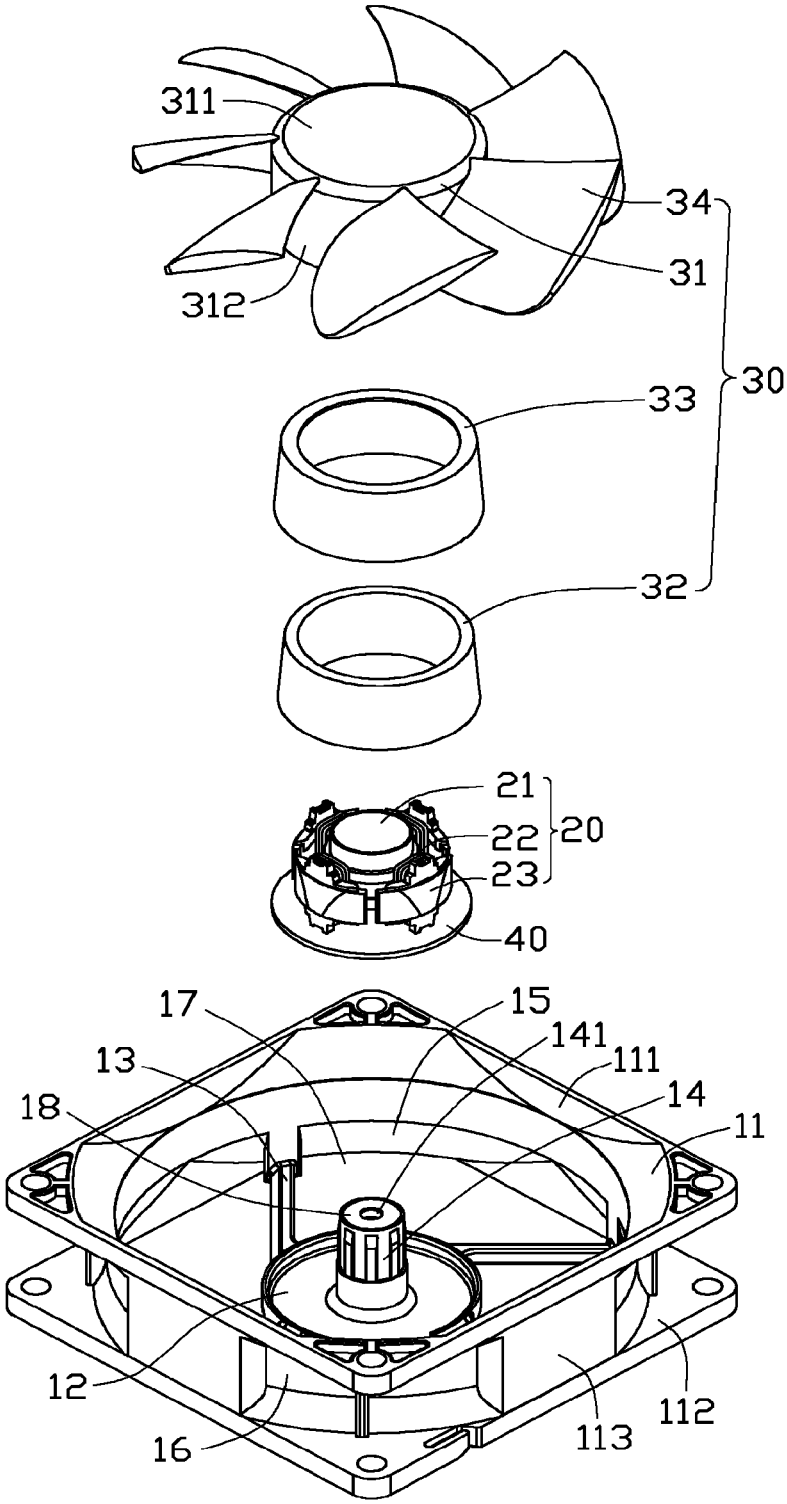
FIG. 2 is an exploded view of the heat dissipation fan of FIG. 1.
Figure 3:
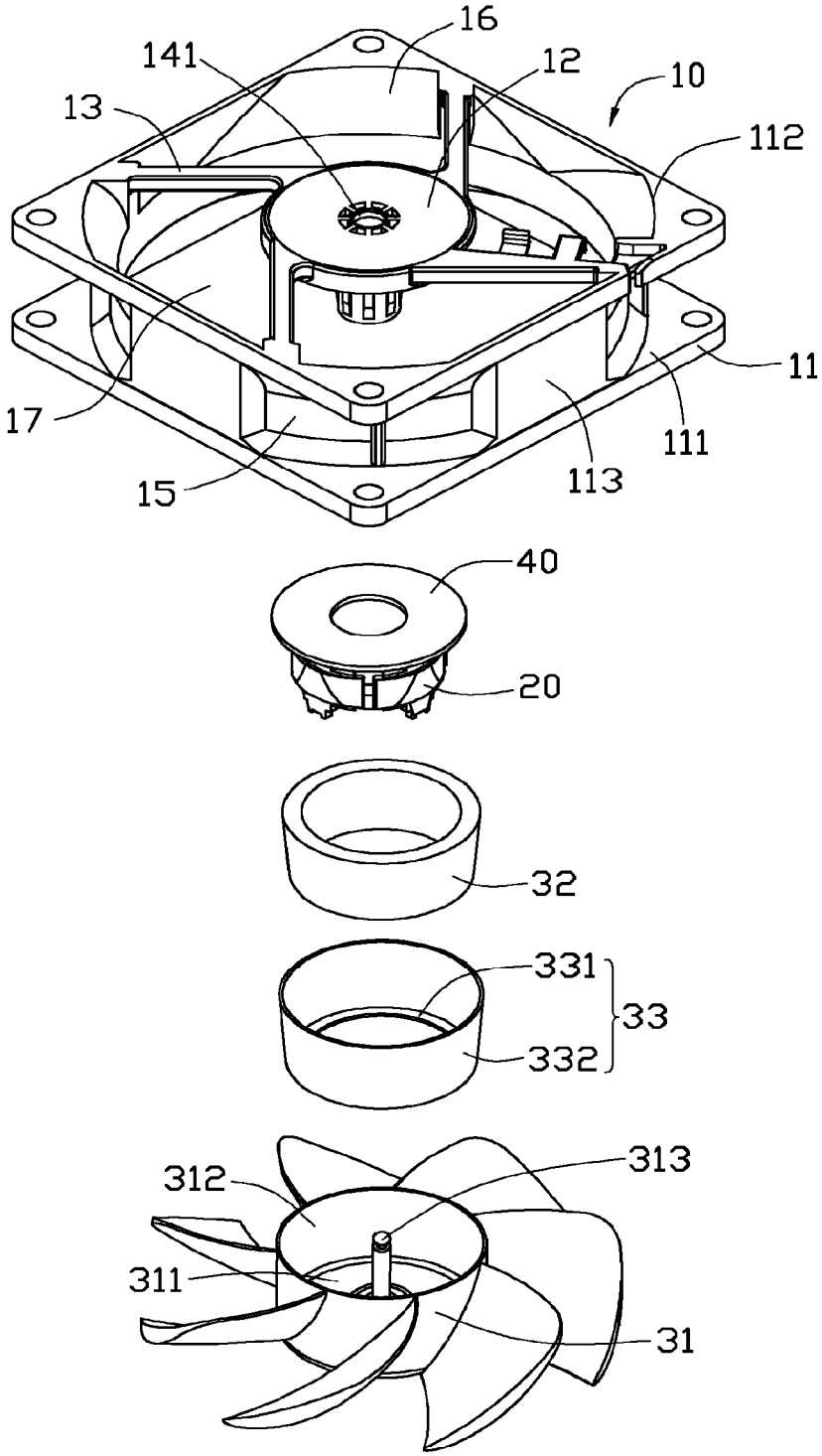
FIG. 3 is similar to FIG. 2, but showing the exploded heat dissipation fan inverted.
Figure 4:
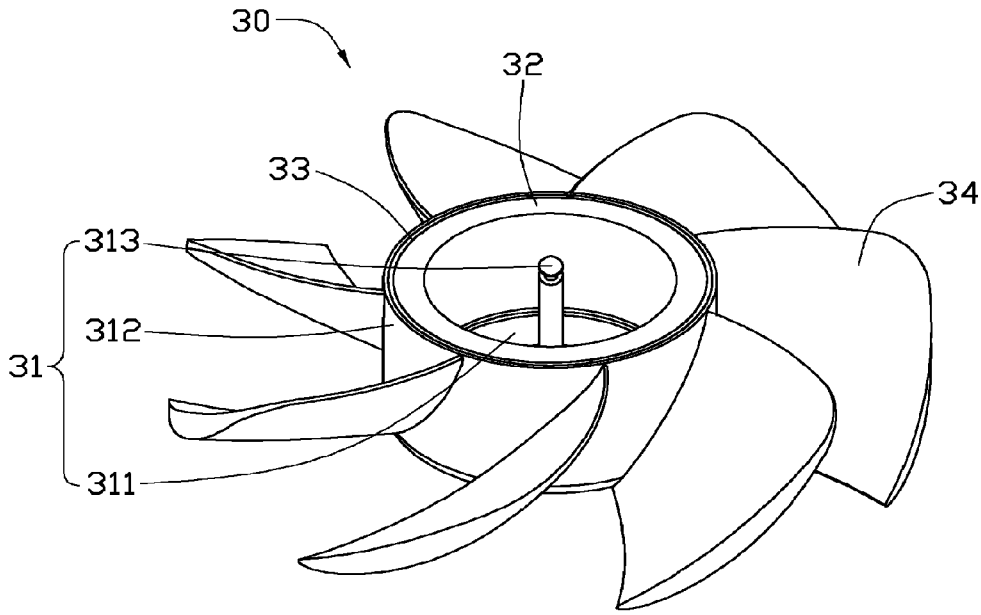
FIG. 4 is an isometric, enlarged view of a rotor of the heat dissipation fan of FIG. 1.

Referring to FIGS. 1 and 2, a heat dissipation fan 100 includes a housing 10, a rotor 30 and a stator 20. The rotor 30 is rotatable about the stator 20.

The housing 10 is generally in the form of a hollow rectangular frame, and includes a top plate 111, a bottom plate 112 parallel to and spaced from the top plate 111, and an annular side plate 113 connected between the top plate 111 and the bottom plate 112. The top plate 111, the bottom plate 112 and the side plate 113 cooperatively define a receiving room 17 for receiving the stator 20 and the rotor 30 therein. An air inlet 15 is defined in a central portion of the top plate 111. An air outlet 16 aligned with the air inlet 15 is defined in a central portion of the bottom plate 112.

The housing 10 also includes a base 12 located at a center of the air outlet 16, a central tube 14 extending upward from the base 12, and a plurality of ribs 13 extending radially from an outer periphery of the base 12 to connect an inner periphery of the bottom plate 112. The central tube 14 defines a central hole 141 therein, and thus includes an open top end. The central hole 141 extends along an axial direction of the central tube 14 for receiving a bearing 18 therein.

The stator 20 defines a through hole 21 at a central portion thereof. The stator 20 includes a stator core 23, a printed circuit board 40 located at a bottom of the stator core 23, and a coil 22 wound around the stator core 23. The coil 22 electrically connects the printed circuit board 40.

The rotor 30 includes a hub 31, a magnet ring 32, a fixing ring 33 and a plurality of blades 34.

The hub 31 includes a circular top wall 311, and an annular side wall 312 depending from a periphery of the top wall 311. The top wall 311 includes a shaft 313 extending perpendicularly downwardly from a center of an inner surface of the top wall 311. The side wall 312 surrounds the shaft 313, and has a constant outer diameter along an axial direction thereof. An inner diameter of the side wall 312 increases gradually from one end which connects the top wall 311 toward the other end which is far away from the top wall 311. Thus, an outer surface of the side wall 312 is a cylindrical surface, and an inner surface of the side wall 312 is formed as a frustoconical surface expanding gradually from one end which connects the top wall 311 toward the other end which is farthest away from the top wall 311. The blades 34 extend radially outwardly from the outer surface of the side wall 312.

Each of the magnet ring 32 and the fixing ring 33 has an inner diameter larger than an outer size of the stator 20. The fixing ring 33 includes a hollow cylindrical fixing wall 332, and an annular flange 331 extending perpendicularly inwardly from a top end of the fixing wall 332. The fixing wall 332 has a shape similar to that of the inner surface of the side wall 312. The annular flange 331 has a width substantially equal to a thickness of a top end of the magnet ring 32.

Figure 5:
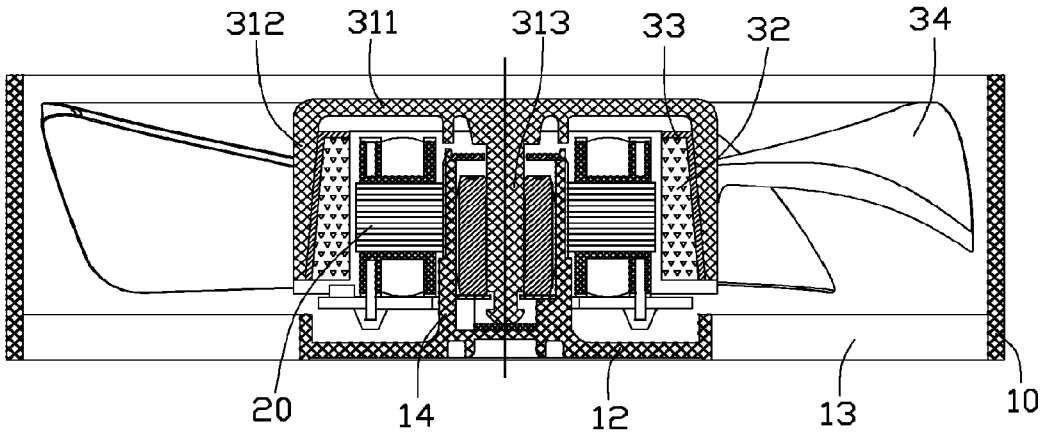
FIG. 5 is a cross-section of the heat dissipation fan of FIG. 1, taken along line V-V thereof.

Referring to FIG. 5, the magnet ring 32 has a wedge-shaped transverse cross section taken at any point along its length. In the illustration, such cross section is trapezoidal. The magnet ring 32 has an outer shape similar to that of the inner surface of the side wall 312. The magnet ring 32 has a constant inner diameter along an axial direction thereof. An outer diameter of the magnet ring 32 decreases from a top end thereof that is adjacent to the top wall 311 of the hub 33 towards a bottom end thereof that is far away from the top wall 311 of the hub 33. Thus, an inner surface of the magnet ring 32 is a cylindrical surface, and an outer surface of the magnet ring 32 is formed as a frustoconical surface expanding gradually from the top end which is adjacent to the top wall 311 toward the bottom end which is far away the top wall 311. Accordingly, the magnet ring 32 has a larger thickness at the bottom end than at the top end.

When assembled, the magnet ring 32 is received in the fixing ring 33, with the outer surface of the magnet ring 32 being affixed to the inner surface of the fixing wall 332 and the top end of the magnet ring 32 abutting against the top flange 331. The inner surface of the magnet ring 32 is parallel to the outer surface of the fixing ring 33. Alternatively, the magnet ring 32 can be slightly larger than the inner diameter of the fixing wall 332 of the fixing ring 33, such that the magnet ring 32 is interferentially fitted into the fixing ring 33. In another alternative embodiment, the fixing ring 33 can be omitted, and the magnet ring 32 is directly assembled into the hub 31.

The stator 20 is mounted around the central tube 14, with the PCB 40 located on the base 12 of the housing 10. The bearing 18 is received in the central hole 141 of the central tube 14. The rotor 30 covers the stator 20, and is assembled to the stator 20 by the shaft 313 being rotatably received in the bearing 18. The rotor 30 is received in the housing 10. The inner surface of the magnet ring 32 faces and is spaced from an outer surface of the stator core 23, with an annular clearance being defined between the inner surface of the magnet ring 32 and the outer surface of the stator core 23.

During operation, an electric current is applied to the coil 22, to establish an alternating magnetic field interacting with a magnetic field of the magnet ring 32 of the rotor 30 to drive the rotor 30 to rotate. Thus rotation of the rotor 30 generates a forced airflow for cooling, e.g., a heat sink and/or an electronic package (such as a CPU).

Due to the thickness of the magnet ring 32 decreasing gradually from the bottom end towards the top end thereof, a magnetic attracting force formed between the magnet ring 32 and the stator core 23 decreases along directions parallel to an axial direction from the bottom end of the magnet ring 32 towards the top end of the magnet ring 32. In this embodiment, along the axial direction of the magnet ring 32, the thickness of the top end of the magnet ring 32 is smallest, and the thickness of the bottom end of the magnet ring 32 is largest. Accordingly, the magnetic attracting force formed between the top end of the magnet ring 32 and the stator core 23 is smallest and the magnetic attracting force formed between the bottom end of the stator core 23 and the magnet ring 32 is largest.

Due to the magnetic attracting force formed between the stator core 23 and the magnet ring 32 decreasing substantially along the axial direction from the bottom end of the magnet ring 32 to the top end of the magnet ring 32, a larger magnetic attraction force acting on the stator core 23 is generated by the bottom end of the magnet ring 32. When rotation of the rotor 30 generates an external pressure pulling the rotor 30 upwardly along the axial direction thereof, the larger magnetic attracting force formed between the stator core 23 and the bottom end of the magnet ring 32 of the rotor 30 acts as a counterforce pulling the rotor 30 downwardly along the axial direction thereof. Thus the axially upward movement and possible floating of the rotor 30 during operation of the heat dissipation fan 100 is avoided, and the problem of noise generated by floating of the rotor 30 is correspondingly avoided.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A heat dissipation fan comprising:

a stator comprising a stator core; and a rotor rotatably mounted around the stator, the rotor comprising a hub and a magnet ring received in the hub, the hub comprising a top wall and a peripheral side wall depending from the top wall, the magnet ring attached to the side wall and surrounding the stator, the magnet ring having a larger thickness as measured in a radial direction at a first end which is far away from the top wall than at a second end which is adjacent to the top wall, such that an attracting force formed between the first end of the magnet ring and the stator core is larger than that formed between the second end of the magnet ring and the stator core.

2. The heat dissipation fan as claimed in claim 1, wherein the thickness of the magnet ring decreases gradually from the first end to the second end.

3. The heat dissipation fan as claimed in claim 2, wherein the magnet ring has a constant inner diameter along an axial direction thereof, and an outer diameter of the magnet ring decreases gradually from the first end to the second end.

4. The heat dissipation fan as claimed in claim 3, wherein the peripheral side wall has a thickness decreases gradually from one end which connects the top wall to the other end which is far away from the top wall.

5. The heat dissipation fan as claimed in claim 4, wherein the peripheral side wall has a constant outer diameter along an axial direction thereof, and an inner diameter of the peripheral side wall increases from the one end to the other end.

6. The heat dissipation fan as claimed in claim 1, wherein the rotor further comprises a fixing ring interconnecting the magnet ring and the peripheral side wall of the hub.

7. The heat dissipation fan as claimed in claim 6, wherein the fixing ring comprises an annular fixing wall and a flange extending inwardly from one end of the fixing wall, an inner diameter of the peripheral side wall increased from one end which is adjacent to the top wall the other end which is far away from the top wall.

8. The heat dissipation fan as claimed in claim 1, further comprising a housing, wherein the housing comprises a top plate, a bottom plate and a side plate connected between the top plate and the bottom plate, an air inlet and an air outlet aligned with the air inlet being respectively defined in the top plate and the bottom plate, the top plate, the bottom plate and the side plate cooperatively defining a receiving room for receiving the rotor and the stator therein.

9. The heat dissipation fan as claimed in claim 8, wherein the housing further comprises a base located at the air outlet, a plurality of ribs extending outwardly from the base to connect an inner periphery of the bottom plate and a central tube extending upward from the base towards the air inlet.

10. The heat dissipation fan as claimed in claim 8, wherein the hub further comprises a shaft extending downwardly from a center of the top wall towards the air outlet of the housing.

11. A heat dissipation fan comprising:

a housing comprising a top plate defining an air inlet therein and a bottom plate defining an air outlet therein;

a stator received in the housing and comprising a stator core; and a rotor rotatable around the stator, the rotor comprising a hub and a magnet ring received in the hub and surrounding the stator, the hub comprising a top wall located at the air inlet, a shaft extending downwardly from a center of the top wall towards the air outlet and a side wall extending downwardly from a periphery of the top wall, the magnet ring having a larger radial thickness at a first end which is adjacent to the air outlet than at a second end which is adjacent to the air inlet, such that an attracting force formed between the first end of the magnet ring and the stator core is larger than that formed between the second end of the magnet ring and the stator core.

12. The heat dissipation fan as claimed in claim 11, wherein the magnet ring is interferentially received in the hub.

13. The heat dissipation fan as claimed in claim 11, wherein the thickness of the magnet ring decreases gradually from the first end to the second end.

14. The heat dissipation fan as claimed in claim 13, wherein the magnet ring has a constant inner diameter along an axial direction thereof, and an outer diameter of the magnet ring decreases gradually from the first end to the second end.

15. The heat dissipation fan as claimed in claim 14, wherein an inner surface of the magnet ring is parallel to an outer surface of the side wall of the hub.

16. The heat dissipation fan as claimed in claim 14, wherein the side wall has a thickness decreases gradually from one end which connects the top wall to the other end which is far away from the top wall.

17. The heat dissipation fan as claimed in claim 16, wherein the side wall has a constant outer diameter along an axial direction thereof, and an inner diameter of the side wall increases from the one end to the other end.

18. The heat dissipation fan as claimed in claim 11, wherein the rotor further comprises a fixing ring interconnected the magnet ring to the side wall of the hub.

19. The heat dissipation fan as claimed in claim 18, wherein the fixing ring comprises an annular fixing wall and a flange extending inwardly from one end of the fixing wall, an inner diameter of the side wall increased from one end which is adjacent to the top wall to the other end which is far away from the top wall.

20. The heat dissipation fan as claimed in claim 11, wherein the housing further comprises a base located at the air outlet, a plurality of ribs extending outwardly from the base to connect an inner periphery of the bottom plate and a central tube extending upward from the base towards the air inlet.

* * * * *